US005205749A

United States Patent [19]

Weingartner

[11] Patent Number: 5,205,749

[45] Date of Patent: Apr. 27, 1993

[54] ELECTRIC PLUG-AND-SOCKET CONNECTION

[75] Inventor: Bernhard Weingartner, Feldkirch, Fed. Rep. of Germany

[73] Assignee: Neutrik Aktiengesellschaft, Schaan, Liechtenstein

[21] Appl. No.: 790,146

[22] Filed: Nov. 8, 1991

Related U.S. Application Data

[63] Continuation of Ser. No. 283,957, Nov. 9, 1988, abandoned.

[30] Foreign Application Priority Data

Mar. 9, 1987 [AT] Austria ..... 540/87

[51] Int. Cl.[5] ..... H01R 13/625

[52] U.S. Cl. ..... 439/335; 439/332

[58] Field of Search ..... 439/332–337, 439/318, 671, 673, 670, 699

[56] References Cited

U.S. PATENT DOCUMENTS

| | | | |
|---|---|---|---|
| 1,781,957 | 11/1930 | Schellenger | 439/670 |
| 3,725,840 | 4/1973 | Hesse | 439/335 |
| 4,255,007 | 3/1981 | Michaels | 439/332 |
| 4,464,001 | 8/1984 | Collins | 439/318 |
| 4,550,967 | 11/1985 | Riches et al. | 439/332 |
| 4,728,304 | 3/1988 | Fischer | 439/857 |
| 4,826,454 | 5/1989 | Kissling et al. | 439/621 |

FOREIGN PATENT DOCUMENTS

| | | | |
|---|---|---|---|
| 0200206 | 10/1958 | German Democratic Rep. | 439/335 |
| 0251041 | 8/1969 | U.S.S.R. | 439/332 |

*Primary Examiner*—Neil Abrams

*Attorney, Agent, or Firm*—Anderson Kill Olick & Oshinsky

[57] ABSTRACT

An electric plug-and-socket connection includes two cylindrical plug-and-socket connectors. Contacts are located in walls of the connectors. One contact is a rod of solid cross-section, wherein part of its cross-section protrudes over the entire length thereof beyond the groove receiving the rod. The other contact has an elastically deformable contact spring member which extends from the wall of a contact support in the direction of the circumference of the contact support and at an increasing distance from the wall of the support.

5 Claims, 2 Drawing Sheets

ELECTRIC PLUG-AND-SOCKET CONNECTION

This is a continuation of application Ser. No. 07/283,957, filed Nov. 9, 1988 and now abandoned.

BACKGROUND OF THE INVENTION

1. Field of the Invention

The invention relates to an electric plug and socket connection.

2. Description of the Prior Art

Electric plug and socket connections are known. During the production of the electrically conducting connection or, respectively, during disengagement or releasing of same, the current-carrying contact faces between two contacts to be paired become gradually larger or, respectively, gradually smaller whereby, in case of current-carrying connections, the specific face load decreases or, respectively, increases. In case of high-loaded contact-providing pairs, contact face parts and zones of contacts can be overloaded, even if perhaps only for a short time, which overloading interferes with the functioning (zone-incremental increase of the transfer resistance) and life-time of the contacts. This danger exists in particular in case of plug and socket connections for loud-speaker systems with high power, as they are employed for example in case of professional music presentations, even though this danger is not limited to systems and plug and socket connections of this kind. In case of an electric plug and socket connection, to which the present invention relates, this refers to such plug and socket connections for energy and information transfer.

A plug is known from the U.S. Pat. No. 4,464,001, where the two casing parts are connected to each other with a so-called bayonet-type coupling. In order to achieve this connection, the two casing parts are initially moved towards each other, in a coaxial position relative to each other, and then they are rotated towards each other. Imaginary parts of front face sections, disposed opposite to each other, consequently experience a relative motion with respect to each other which is initially disposed parallel to the axis of the plug and, subsequently thereto, a relative cross motion on a circular arc line. For this purpose, this plug is also provided as a single-pole plug. The plug includes a central contact pin, as well as a contact bush which receives this contact pin. A plug with such a locking can therefore not be formed as a multiple plug without difficulties.

A plug connection is illustrated and described in the U.S. Pat. No. 4,550,967, where the two plug parts are coupled to each other by an axial linear motion. A cylindrical insulator is embedded in one plug part, where contact bushes are resting in the cylindrical insulator. These contact bushes receive contact pins, which are supported in the counterpart. This plug connection includes a snap lock coupling, which serves to secure the coupled plug parts in their position. On the outside at the cylindrical casing of the plug part, there are disposed cylindrical bolts at a uniform distance from each other, which cylindrical bolts are received by grooves in the counterpart. On the side of such a groove, there are disposed annular springs, which protrude with one part of their circumferential section into the groove. If the two plug parts are joined, then the bolt slides along the groove, reaches the narrow sections, and presses the springs toward the outside and thus passes into the rear-side or end-side part of the groove. In this position, the bolts release the springs again, which springs then spring into the groove cross-section and thus form a narrowed locking location for this bolt. This snap lock coupling is constructed in a very expensive manner.

SUMMARY OF THE INVENTION

It is an objective of the invention to eliminate the initially illustrated disadvantages of conventional plug connections and to create a plug connection where the contacts, both during their contact-making pairing coupling as well as during the disengagement, can be rapidly separated from each other over a large area. The solution of this object is achieved according to the invention by an electric plug-and-socket connection with a plug connector and a plug-in counterpart connector which include contacts located in grooves in the walls of the connectors. One of the contacts is a rod member of solid cross-section, wherein part of the cross-section protrudes over the entire length thereof beyond the groove receiving the contact. The other contact has an elastically deformable contact spring member which extends from the wall of the contact support of circular cross-section in the lug connector. The contact spring member extends in the direction of the circumference of the support and at an increasing distance from the wall of the supports. Based on this disclosure, the contacts to be coupled are in fact moved against each other crosswise to their longitudinal extension, both during their contact-providing connection as well as during disengagement, even though a plug and socket connection is involved, where the contacts extend in the axial direction of the plug and socket connection.

BRIEF DESCRIPTION OF THE DRAWINGS

Without limiting the invention, the invention is described and illustrated by way of a specific embodiment. There is illustrated in FIG. 1, a cup-shaped plug connector in a longitudinal section.

DESCRIPTION OF THE PREFERRED EMBODIMENTS

It is noted that only the immediately active parts of the plug connectors are illustrated here, however, not the details about the connection possibilities for the current-conducting and voltage-conducing lines, for their mounting, for the manipulation of the plug and socket connection and such similar items.

Figure 1:
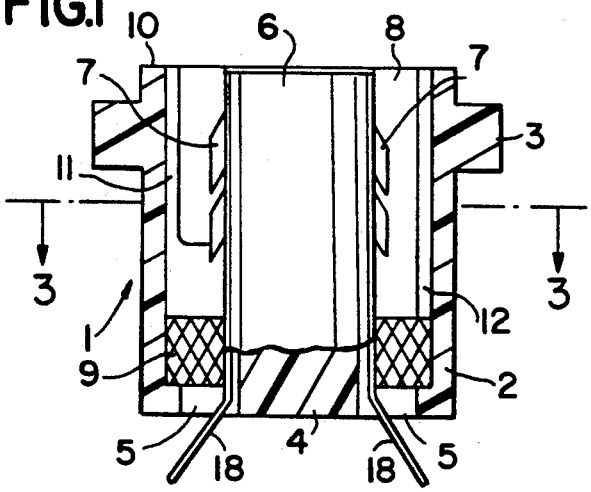
Figure 3:
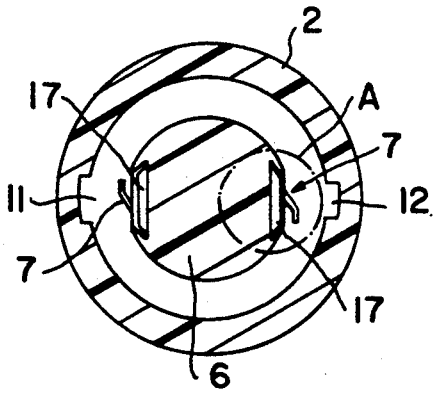
FIG 3, a cross-section according to line III—III in FIG. 1.
Figure 6:
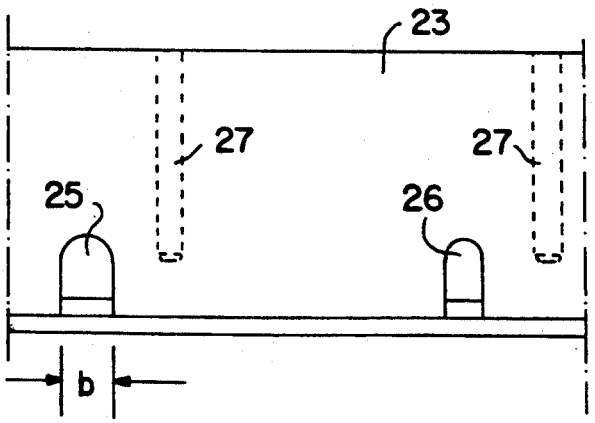
FIG. 6, the unwinding of the outer jacket of the counterpart according to FIG. 5.
Figure 2:
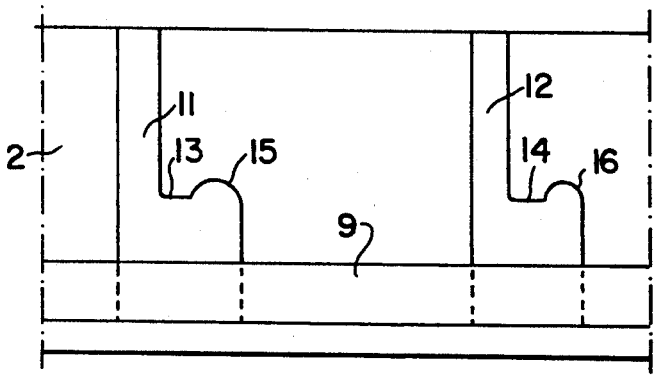
FIG. 2, an unwinding of the inner wall of the plug connector according to FIG. 1.
Figure 13:
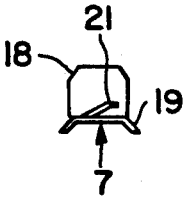
FIGS. 10, 11, 12, and 13, the contact including contact vanes in a plan view, a side view, a bottom view, and in a section according to section line XIII—XIII in FIG. 10.
Figure 10:
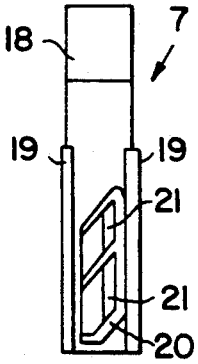
Figure 11:
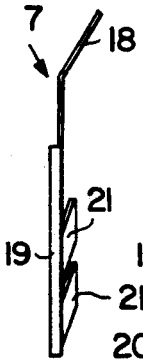
Figure 12:
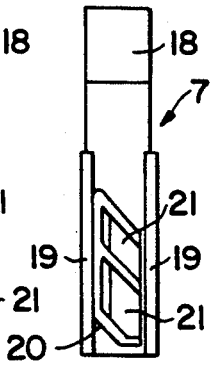
Figure 7:
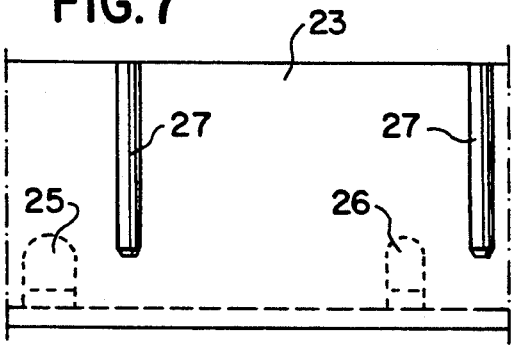
FIG. 7, the unwinding of the inner jacket of the counterpart according to FIG. 5.

The plug and socket connector 1 according to FIG. 1, illustrated in a longitudinal section, if formed in this case as chassis plug and exhibits a cup-shaped, circular cylindrical casing 2, made of electrical insulating material, with an attachment flange 3 and a floor 4, which is furnished with breakouts 5 for plugging through of contacts 7, which are disposed at a central, circular cylindrical shaft 6, which is formed as a single piece with the casing 2 and its floor 4. The shaft 6 limits a cylindrical annular space 8 with the inner wall of the casing 2. A ring-shaped insert 9, made of an elastic, volume-compressible material such as, for example, polyurethane, is disposed at the floor 4. Axially parallel grooves 11 and 12 are formed in the inner circumferential surface of casing 2. The grooves have different widths b and run from the outer edge 10 of the cup-shaped casing 2 in a parallel and diametric disposition, where in each case the grooves have a sloped flank 13, 14 passing over into an inclination, which subsequently runs out into an undercut 15 extending towards the edge 10. The two sloped flanks 13 and 14 are inclined by an equal angle against an imaginary horizontal plane (as referred to FIG. 2). It is within the scope of the invention that these two sloped flanks can run crosswise to the axis of the casing such that they are disposed substantially parallel to the edge 10. The center shaft 6 serves as a contact support of this plug connector 1, which shaft 6 is provided with dovetail-shaped longitudinal grooves 17 in a diametric disposition in the cross-section, where the contacts 7 are anchored in the longitudinal grooves 17, and where the connection clips of said contacts 7 protrude rearwardly out of the cup-shaped casing 2.

Figure 4:
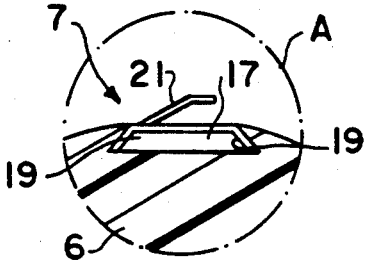
FIG. 4, a detail from FIG. 3, which is designated in FIG. 3 by the line A.

These contacts 7, which are received by the contact support of center shaft 6 are illustrated in detail in FIGS. 10 to 13 in an enlarged scale as compared to FIG. 1. These contacts 7 comprise a longitudinally extended lamella with an angled connection clip 18. The longitudinal edges 19 are angled. Contact vanes 21 are punched free at this location in the middle region by two U-shaped punch-section cuts 20, and in fact in such manner that the center web of the U-shaped punch-section cut runs substantially parallel to the longitudinal extension of the lamella, similar the bending edge of the contact vane 21. These free-punched contact vanes 21 are bent upwardly and run at an angle relative to the plane of the lamella. The contact 7 inserted into the groove 17 of the center shaft 6 is thus provided with contact vanes 21, which start out at the wall of the shaft 6, extend in the circumferential direction of the shaft 6, and increase thereby their distance from the wall of the shaft 6 serving as a contact support (FIG. 4). It is within the scope of the invention to provide more than two contact vanes 21 of this kind at the contact lamella. The lamella of the contact 7 includes different wall thicknesses over its length, whereby the wall thickness of the connection clip is about two times to three times as strong as the wall thickness of the section carrying the contact vanes 21, such that the connection clip 18 is sufficiently stiff against bending in order to possibly attach the current and voltage-carrying conductor with a clampable clamp.

Figure 5:
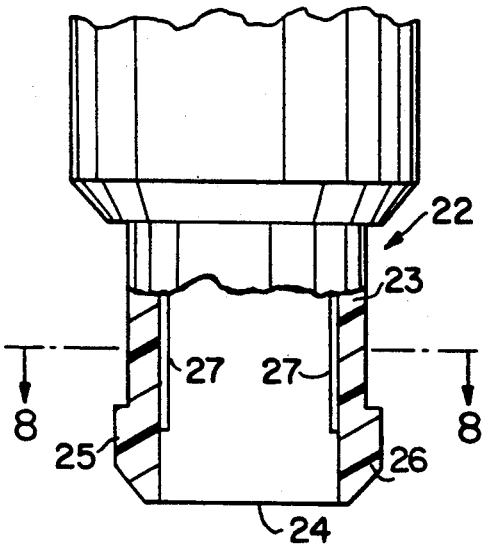
FIG. 5, the plug-in counterpart in a longitudinal section.
Figure 9:
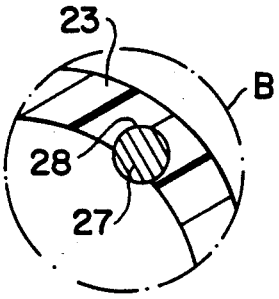
FIG. 9, the detail from FIG. 8, which is designated there by the line B.

The plug-in counterpart connector 22 is illustrated in a longitudinal section in FIG. 5. It is formed as hollow cylinder 23. Noses 25 and 26 of different widths are disposed at the outer jacket face near the front face 24 and in diametric position. Longitudinally running, axially parallel grooves 28 are provided at the inner jacket face, into which profile rods 27 with a circular-shaped solid cross-section are pressed in, which serve as contacts. The grooves 28 are provided with a cross-section corresponding to the cross-section of the profile rods 27 and they surround the profile rods 27 over their length along the circumference by more than half, such that these profile rods 27 protrude only with a small part of their cross-section versus the groove 28 (FIG. 9). These profile rods are furnished at their inner end with a connection means for the electrical conductors, not illustrated here.

Figure 8:
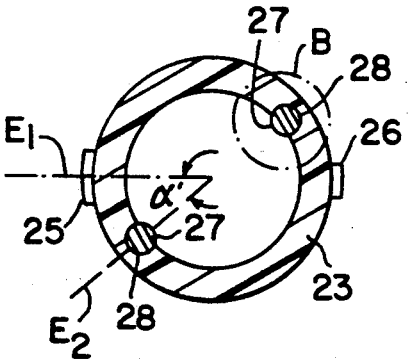
FIG. 8, a cross-section through the counterpart according to FIG. 5 along section line VIII—VIII.
Figure 14:
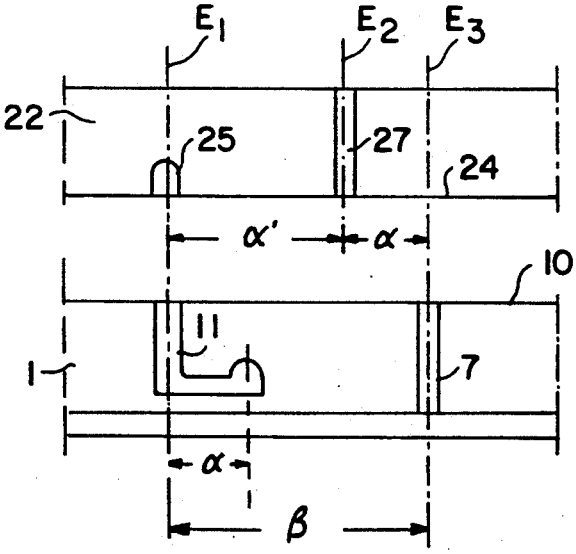
FIG. 14, a schematic representation, illustrating the mutual position of the contacts and locking and bolting elements.

FIG. 14 illustrates schematically the position of the contacts 7 or 27 versus the nose 25 or, respectively for the groove 11 provided for receiving them. The two imaginary cross-sectional planes E1 and E2 of the counterpart connector 22, of which the one includes the nose 25, and of which the other one includes a contact 27, enclose relative to each other an angle alpha' (compare also FIG. 8), which is illustrated in this case as an uncoiled arc length in FIG. 14. The two imaginary cross-sectional planes E1 and E3 of the plug connector 1, of which the one includes the section of the groove 11 running in axial parallel direction, and of which the second one includes the contact 7, enclose with each other an angle beta, which is illustrated here as an angled arc length. The cross-sectional plane, which is coordinated to the coupling locking elements, is designated with E1 for the two plug and socket connectors 1 and 22. The difference between the two angles alpha' and -beta corresponds to the rotation angle alpha, which the two plug and socket connectors 1 and 22 are rotatable relative to their contact-providing coupling locking.

In order to provide a contact-furnishing connection, the two plug and socket connectors 1 and 22 are guided axially, whereby the noses 25 and 26 are received by the grooves 11 and 12. Because the width of the noses is different and also because the grooves provided for their reception exhibit corresponding widths, the two plug and socket connectors can only be plugged together in a pre-set radial positioning. During the mentioned insertion, the contacts 7 and 27 are staggered relative to each other by an angle alpha. If the counterpart connector 22 has reached its inner position, whereby the front face resets at the insert 9 and deforms the insert 9, such that, by subsequent mutual rotation of the plug and socket connectors 1 and 22, the noses 25 and 26 can be moved along the sloped flanks 13 and 14 into their locking position, whereby the elastically deformable insert 9, based on its restoring force, presses the noses into the undercuts 15 and 16 provided for the noses. Thereby the two plug and socket connectors 1 and 22 are coupled and locked with each other, whereby the electrical contact is simultaneously furnished, whereby the contacts 7 and 27 have been moved against each other crosswise to their longitudinal extension for this contact-providing connection, such that the contacts 7 and 27 contact each other at the moment of the contact-creation at a large surface.

The plug and socket connectors are disengaged and unlocked in reverse sequence, where the contacts 7 and 27 then lift of from each other again crosswise to their longitudinal extension, and thus the current-conducting connection is interrupted over a large surface and suddenly.

If two-pole connectors have been illustrated in the embodiment, it is within the scope of the invention to provide in pairs also several contacts along the jacket face. Furthermore, it is possible, again within the scope of the invention, to form the cylindrical shaft 6 of the plug connector 1 as a hollow cylinder and also to furnish then the hollows with contacts 7, whereby the plug counterpart includes a center shaft, which then again is furnished with contacts. If in the illustrated embodiment there are disposed lamella contacts 7 with contact vanes 21 in the one plug connector, and in the plug-in counterpart pin-shaped contacts 27 with a solid cross-section, then this contact disposition can also be exchanged or disposed on opposite sides. If the annular-shaped insert 9, made of elastic, volume-compressible material, is disposed at the floor 4 of the cup-shaped casing 2 of the plug connector 1, then it would also be possible to furnish an insert of this kind either at the front face of the center shaft 6 or at the edge 10 of the casing 2. Correspondingly, such an insert can also be disposed at the plug-in counterpart 22. This insert 9 comprises elastic insulating material such that no special constructive steps have to be taken in order to place the insert 9, serving as a spring element, in the narrow limited space provided. In all these cases, the insert 9 has the purposes to provide a force acting in axial direction for the coupling locking of the plug and socket connectors 1 and 22.

It can also be recognized from the figures that the outer ends of the contacts 7 or, respectively, 27 are recessed versus the respective front face of the plug connector such that these contacts are places contact-voltage proof. Based on the solution provided by the present invention, it is avoided that, upon opening of the contacts based on the continuous decrease of the contact faces, the current density increases by an impermissible degree, whereby a so-called contact burn-up or, respectively, and arcing is avoided.

I claim:

1. In an electric plug-and-socket connection including a cylindrical plug connector and a cylindrical plug-inn counterpart connector, each connector having an axis, each connector including contact supports and contacts, wherein the plug connector and the plug-in counterpart connector are coupleable by a bayonet-type coupling, the plug connector being cup-shaped and having a circumferential wall and a circumferential edge and a bottom remote from the edge, grooves being defined in the wall of the plug connector, the grooves having a first portion extending parallel to the axis of the connector and a second portion extending circumferentially adjacent the first portion, the second portion having a length which determines and angle of relative rotation between the plug connector and the counterpart connector, the counterpart connector is a rod of solid cross-section, the rod being received in an axially extending recess of the contact support, the rod projecting over its entire length radially beyond the contact support, wherein two imaginary diameter planes of the connector with the rod contact extending through the contact and the at least one nose are offset relative to each other by an angle which corresponds to the angle of relative rotation between the connectors, each of the other contacts being received in a recess of the other contact support of the plug connector, the other contact support having a wall, the recess being provided in the wall, the improvement comprising the other contacts in the other contact support each having at least one elastically deformable contact vane, the at least one contact vane extending in circumferential direction from the wall of the contact support and at a distance from the wall of the contact support which increases in circumferential direction.

2. The electric plug-and-socket connection according to claim 1, comprising an annular compressible insert placed on the bottom of the plug connector, the annular insert contacting the counterpart connector when the connectors are coupled.

3. In an electric plug-and-socket connection including a cylindrical plug connector and a cylindrical plug-in counterpart connector, each connector having an axis, each connector including contact supports and contacts, wherein the plug connector and the plug-in counterpart connector are coupleable by a bayonet-type coupling, the plug connector being cup-shaped and having a circumferential wall and a circumferential edge and a bottom remote from the edge, grooves being defined in the wall of the plug connector, the grooves having a first portion extending parallel to the axis of the connector and a second portion extending circumferentially adjacent the first portion, the second portion having a length which determines and angle of relative rotation between the plug connector and the counterpart connector, the counterpart connector having at least one nose for insertion in the grooves of the plug connector, wherein each contact of the counterpart connector is a rod of solid cross-section, the rod being received in an axially extending recess of the contact support, the rod projecting over its entire length radially beyond the contact support, wherein two imaginary diameter planes of the connector with the rod contact extending through the contact and the at least one nose are offset relative to each other by an angle which corresponds to the angle of relative rotation between the connectors, each of the other contacts being receive in a recess of the other contact support of the plug connector, the other contact support having a wall, the improvement comprising the other contacts in the other contact support each having at least one elastically deformable contact vane, the at least one contact vane extending in circumferential direction from the wall of the contact support and at a distance from the wall of the contact support which increases in circumferential direction, and contact with the at least one contact vane being an elongated lamella, the lamella having longitudinally extending bent edges, the recess receiving the contact with the contact vane being dovetail-shaped, the lamella having a middle portion, the contact vane being punched out of the middle portion by U-shaped punching cuts, the contact vane being bent at an angle relative to the plane of the lamella, wherein the U-shaped punching section has a web extending essentially parallel to the longitudinal axis of the lamella.

4. The electric plug-and-socket connection according to claim 3, wherein the lamella has over the length thereof different wall thicknesses, the portion of the lamella with the at least one vane being thinner than the remaining length of the lamella.

5. The electric plug-and-socket connection according to claim 4, wherein the wall thickness of the remaining length of the lamella is two to three times greater than the wall thickness of the lamella with the at least one vane.

* * * * *